US006923712B2

(12) United States Patent
White

(10) Patent No.: US 6,923,712 B2
(45) Date of Patent: Aug. 2, 2005

(54) METHOD AND APPARATUS FOR GRINDING ROTORS FOR HYDRAULIC MOTORS AND APPARATUS THEREFOR

(75) Inventor: Hollis Newcomb White, Hopkinsville, KY (US)

(73) Assignee: White Hydraulics, Inc., Hopkinsville, KY (US)

( * ) Notice: Subject to any disclaimer, the term of this patent is extended or adjusted under 35 U.S.C. 154(b) by 0 days.

(21) Appl. No.: 10/024,973

(22) Filed: Dec. 19, 2001

(65) Prior Publication Data

US 2002/0052168 A1 May 2, 2002

Related U.S. Application Data

(62) Division of application No. 09/301,798, filed on Apr. 29, 1999, now Pat. No. 6,425,807.

(51) Int. Cl.[7] ..... B24B 1/00

(52) U.S. Cl. ..... 451/47; 451/147; 451/148

(58) Field of Search ..... 451/8, 47, 147, 451/148, 900, 161, 219, 253, 275, 379, 380, 387, 403, 402, 413, 414; 269/37, 38, 39, 40, 41, 42

(56) References Cited

U.S. PATENT DOCUMENTS 4,602,458 A * 7/1986 Erhardt et al.
4,650,378 A * 3/1987 Zubler
4,697,387 A * 10/1987 Wirz
5,379,554 A * 1/1995 Thurman et al. ..... 451/177
5,737,985 A * 4/1998 Rimlinger, Jr. ..... 82/165
5,807,164 A * 9/1998 Junker ..... 451/47

* cited by examiner

*Primary Examiner*—Dung Van Nguyen
(74) *Attorney, Agent, or Firm*—Lightbody & Lucas

(57) ABSTRACT

A fixture for selectively locating and retaining hydraulic gerotor rotors in position in respect to a grinding wheel, the fixture clamping the rotor between two oversized positioning rolls located in rotor lobe valleys on opposite sides of the rotor.

40 Claims, 6 Drawing Sheets

METHOD AND APPARATUS FOR GRINDING ROTORS FOR HYDRAULIC MOTORS AND APPARATUS THEREFOR

This is a Divisional of application Ser. No. 09/301,798, filed Apr. 29, 1999, now U.S. Pat. No. 6,425,807.

FIELD TO WHICH THE INVENTION RELATES

This invention relates to an improved method and apparatus for grinding rotors and other developed parts together with an apparatus to accomplish same.

BACKGROUND OF THE INVENTION

Grinding machines have been utilized to finish developed parts for subsequent use in mechanical and other mechanisms. The purpose of the grinding machine is to finish the developed surface of a part, typically metal, so as to provide for the necessary shape and dimensions thereof. Examples of developed parts include a hydraulic device valve as disclosed in the U.S. Pat. No. 5,173,043 entitled REDUCED SIZE HYDRAULIC MOTOR, and the rotor as disclosed in the U.S. Pat. No. 4,357,133 entitled ROTARY GEROTOR HYDRAULIC DEVICE WITH FLUID CONTROL PASSAGEWAYS THROUGH THE ROTOR. Taking the hydraulic motor rotor as an example, the outer surface of this rotor has a generated developed surface, which surface must be tightly controlled in order to cooperate with the rolls of the surrounding stator in order to provide for a volumetrically and mechanically efficient gerotor mechanism. The grinding of this outer surface allows for the developing and maintaining of tighter spacing and tolerances between the rotor and surrounding stator, thus also maintaining tighter quality control between successive units.

SUMMARY OF THE INVENTION

It is an object of this invention to reduce the cost of ground parts;

It is an object of this invention to improve the maintenance of tolerances in ground parts;

It is an object of this invention to simplify the manufacture of ground parts;

It is another object of this invention to increase the speed of manufacture of ground parts;

Other objects and a more complete understanding of the invention may be had by referring to the drawings in which:

DETAILED DESCRIPTION OF THE INVENTION

Figure 1:
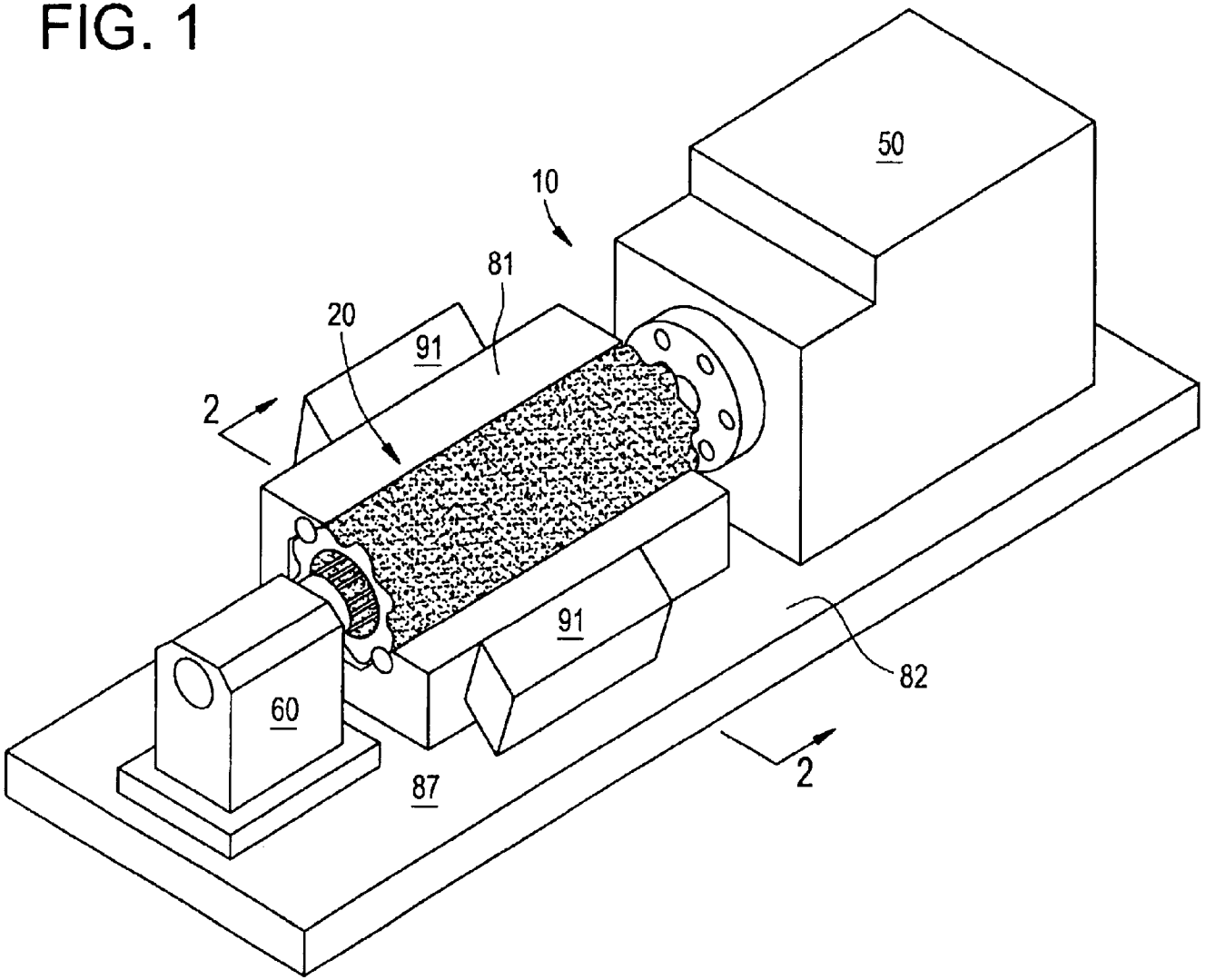
FIG. 1 is a perspective view of a fixture for a grinding apparatus to accomplish the invention.

This invention relates to an improved grinding apparatus together with the method of use thereof.

The present invention relates to an apparatus and method for finishing a developed surface on manufactured parts. By developed surface, it is meant a definable (typically mathematically) non-linear surface segmented into discreet, typically similar, sections. The invention will be described in its preferred embodiment of a grinding apparatus for a rotor of a gerotor pressure mechanism. It is to be understood that the invention is amenable to other parts and manufacturing processes.

The developed parts can, and typically do, undergo certain initial manufacturing steps prior to being ground. For example in the preferred embodiment, the rotors each begin as a rotor blank having rough formed outer rotor lobes and a circular hole in its center. This rotor is then semifinished by having the wobblestick drive splines formed extending outwards of the center circular hole and initial grinding of the outside of the rotor. At this point, the rotor is amenable to the grinding operation of the present invention. In this rotor, a developed surface is that which can be accessed in its entirety by movement of a grinding wheel in a single direction. To minimize the complexity of the grinding wheel, it is preferred that the developed surface be a repeatable segment. For example: a) top one rotor lobe to the top of the next rotor lobe; b) bottom one rotor valley to the bottom of the next rotor valley; c) part up one rotor lobe to part up the next rotor lobe; and, d) etc. This facilitates the merger of adjoining developed surfaces without significant wasteful overlap.

The exact nature of the initial manufacturing steps are not important except insofar as these steps might create a reference point(s) for the subsequent grinding operation. For example in the preferred embodiment, the outside surface of the rotor lobes forms an initial starting position for grinding two reference surfaces. Therefore, the initial manufacture of the rotor lobes should preferably establish such points. (Note since the central drive splines serve to index the rotor's lobes, it is important that the orientation of such splines to the rotor lobes be known. In the preferred embodiment, alternate splines are aligned on the centerline of the lobes are utilized. Note, however that since the indexer is disengaged during grinding, a single spline would be functional.) With other parts being ground, the reference(s) may be different.

The eight lobed rotor utilized as a starting point for the preferred embodiment of this invention has a distance across opposing rotor lobes of 2.87", a distance across opposing rotor valleys of 2.37" with a central hole some 1.5" in diameter having 16 splines extending outwards thereof. The pitch diameter of the splines is 1.6" with a 30° pressure angle. The centerline of alternate splines are aligned with the centerline of the lobes within five seconds. The rotor has an RC 60 hardness.

The outside surface of this rotor will be ground to have a distance of 2.84" across opposing rotor lobes and a distance across opposing rotor valleys of 2.34". The spline dimensions are unchanged.

The production rolls to be utilized in the stator for the gerotor device are 0.5" in diameter.

Figure 2:
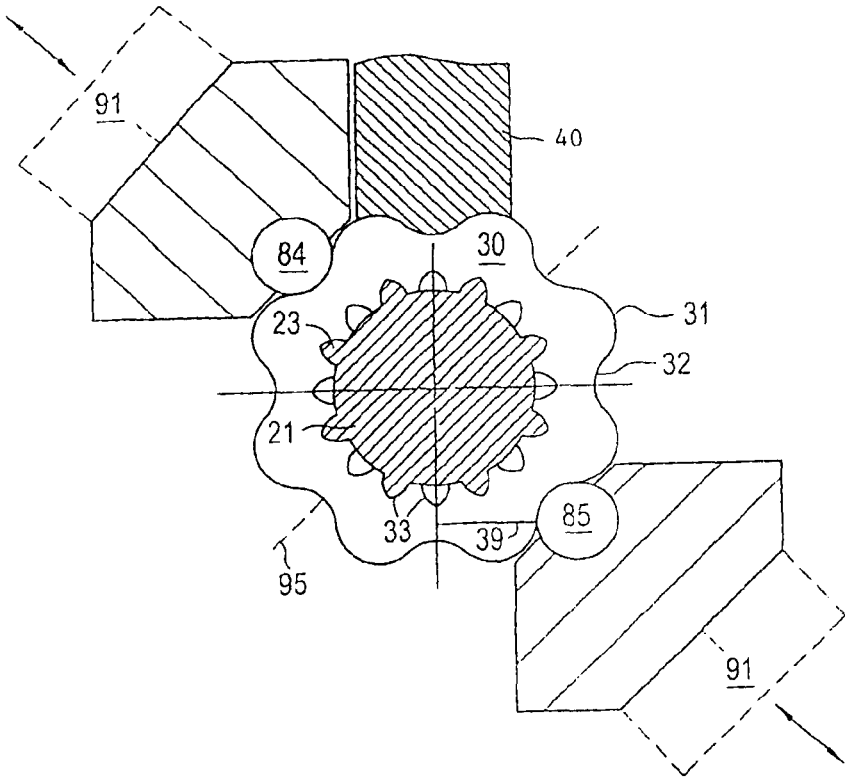
FIG. 2 is a cross-sectional view of the grinding apparatus of FIG. 1 with the grinding wheel in location taken generally in the plane 2—2 therein.
Figure 3:
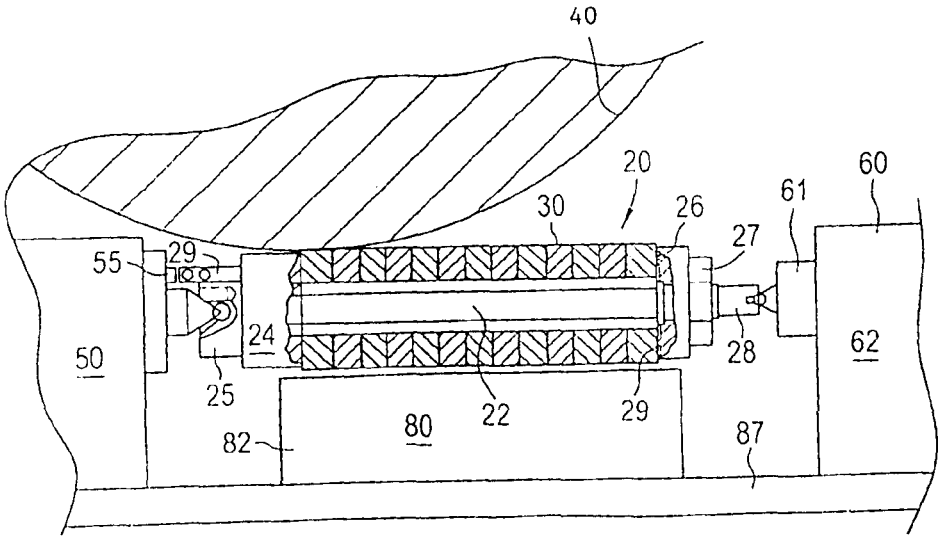
FIG. 3 is a longitudinal cross-sectional view of the fixture utilized to hold the undeveloped parts in the grinding apparatus of FIG. 1.

The grinding apparatus 10 is designed to carry out the preferred embodiment of the invention. As such, it is a complete manufacturing system for carrying out the preferred method described herein. The particular grinding apparatus 10 disclosed includes a parts arbor 20, an indexer 50, a tailstock 60 and the fixture 80 (FIGS. 1, 2 and 3).

The parts arbor 20 is designed to hold the parts in position in respect to the remainder of the grinding apparatus is order to allow the manufacturing operation to occur therewith. In the preferred embodiment, this parts arbor 20 holds a series of parts in position, thereby to allow for the manufacturing operation to occur on multiple parts with a single setup.

The particular parts to be manufactured by the preferred embodiment are rotors 30 for a hydraulic gerotor structure. These rotors include external rotor lobes 31 and valleys 32 which are to be subject to the present manufacturing operation in combination with a previously formed set of internal splines 33.

To maintain these rotors 30 in position, the parts arbor 20 includes a body 21 having an elongated formed mandrel 22 with teeth 23 formed thereon. The elongated section 22 is designed to allow a stack of multiple rotors 30 to be assembled thereon. The teeth 23 aid in this assembly by cooperating with the internal splines 33 of the rotors 30 so as to rotationally affix the rotors 30 to the body 21 of the parts fixture. The stack of rotors 30 are longitudinally retained onto the parts fixture by an enlarged end 24 of the body 21 of the parts fixture together with a washer 26 and nut 27 engaged to threads 28 at the other end of the body 21. Once the nut 27 is tightened down, a single integral assembly of the rotors 30 surrounding the parts arbor 20 is created. Both the enlarged end 24 and the washer 26 have recessed end walls except for a raised concentric band 29 located intermediate the outward extension of the teeth 23 and the inward extension of a ground rotor valley 32. These bands 29 serve to concentrate the clamping forces near the areas being ground, thus to better retain the rotors 30 in position. A contact closer to the, while still missing, ground rotor valley 32 is preferred.

Note that the number of teeth 23 of the parts arbor 20 differ from the number of internal splines 33 on the rotors 30. This is because the later described fixture 80 serves to angularly and radially retain the stack of rotors 30 in position in respect to the grinding apparatus 10 during grinding, with the parts arbor primarily initially locating the stack of rotors 30 in indexed position in respect to the grinding apparatus. It is preferred that there be at least one tooth 23 engaging the rotor in a known fashion so as to reliably index the rotor lobes in respect to the grinding wheel (operation to be later described).

It is envisioned that there would be multiple parts arbors 20 for the grinding apparatus 10 so as to allow for the efficient setup of the apparatus and reduce the time that the grinding apparatus is not in actual use manufacturing parts.

The indexer 50 and tailstock 60 cooperate with the parts arbor 20 so as to rotatively and longitudinally locate the stack of rotors 30 in respect to the grinding apparatus 10. To accomplish this the indexer 50 engages one end 25 of the parts arbor while the tailstock 60 engages the other end 28 of the parts arbor. This is preferred over alternate longitudinal retention means due to the inherent combining of functions. If desired or necessary (such as with high axial manufacturing forces on the rotors) separate clamps or stops could be utilized by themselves and/or additionally to longitudinally restrain the manufactured parts.

The particular indexer 50 disclosed has a rotating drive system including a motor, a positioning sensor and a control system (within the indexer; thus not shown). The rotating drive system of the indexer 50 is designed to preliminarily locate the parts in an indexed position, in the particular embodiment disclosed with the later described grinding wheel 40 over the center of a rotor valley 32.

The indexer 50 in addition includes a key drive 55 that selectively engages a key 29 on the arbor 20 in order to initially position the parts to be ground in respect to the grinding apparatus 10. In the preferred embodiment disclosed, this indexer key is engaged during rotary indexing movement of the arbor, with it being subsequently being disengaged during the actual grinding operations. With this separation of the rotating indexing function from the clamped grinding function, there is no interference between the two. Thus the ability of the later described fixture 80 to precisely locate the rotors 30 in respect to the grinding wheel 40 is not compromised. Alternately, the key drive could be lost motion and/or have a sufficient degree of resiliency (i.e., rubber, synthetic, springs, etc. between the two) such that the continual engagement thereof would not compromise the accuracy of the clamped grinding position of the rotor stack.

The tailstock 60 serves to support the free end of the arbor 20. In the embodiment disclosed, this tailstock includes a rotating spindle 61 supported by a movable body 62. The rotating spindle 61 serves with the indexer 50 to support the arbor 20 for rotation in respect to the remainder of the apparatus 10 as well as the longitudinal retention previously set forth. The moveable body 62 in addition serves to engage and disengage the arbor 20 into operative position in respect to the grinding apparatus 10 by moving longitudinally in respect to the apparatus 10, thus allowing the arbor to be removed from the grinding apparatus 10 for replacement with a subsequent arbor. This operation of this tailstock 60 is under the control of the operator.

Once engaged, the parts arbor 20 is longitudinally locked in respect to the indexer 50 and the tailstock 60. Due to this, any longitudinal forces that occur during the actual grinding operation are absorbed thereby. This reduces the clamping requirements for the fixture 80, thus allowing this fixture 80 to be optimized for a precise angular positioning function. (Note that a small longitudinal shift is acceptable provided a definite stop is provided, which stop could be an additional part or parts.)

It is preferred that both the indexer 50 and tailstock 60 allow a small measure of radial or angular movement of the arbor 20. This movement is to avoid interference between these parts and the manufacturing fixture 80 (i.e., the positioning of the parts by the fixture 80 is not compromised by the indexer 50 and/or tailstock 60). Indeed the positioning by the fixture 80 is sufficiently decisive that the indexer 50 and tailstock 60 could be disengaged or even omitted during grinding of the rotors 30 with no significant effect: The indexer and tailstock serving primarily to rotate the parts in a computerized manufacturing operation. One would, however, want to have a longitudinal stop as previously set forth.

In the invention of this present application, the reference for the manufacturing operation performed by the apparatus 10 is the external surface of the parts being manufactured, in the embodiment shown the rotors 30 being ground. In the preferred embodiment, two external references are provided by a set of two fixtures 81, 82. These fixtures are out of contact with the manufactured part during the indexing thereof, with contact returning during the actual grinding operation. In certain instances, only a single reference may be utilized. Both or either of the fixture and part could be moved to establish the selective contact.

In the preferred embodiment, the two fixtures 81, 82 are designed to contact the part with a simple single direction supported movement of each. This simplifies the design while allowing for repeatability without the necessity of measurement each time the fixtures are engaged.

Figure 4:
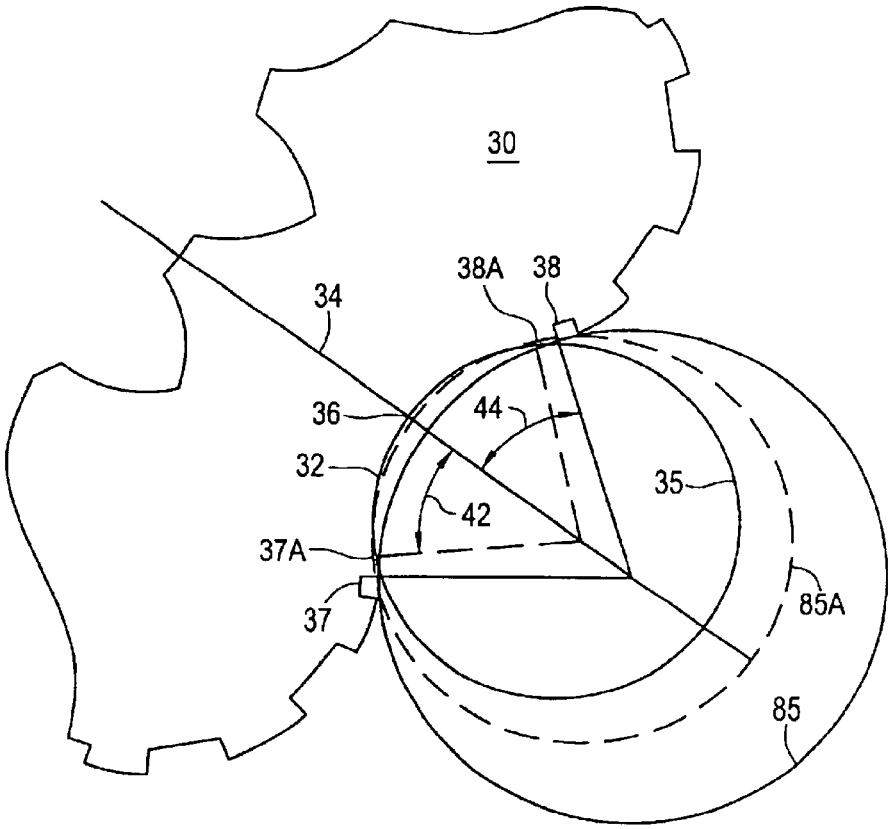
FIG. 4 is an enlarged view of a portion of FIG. 2 detailing the sizing of the preferred rotor positioning rolls utilized in the invention.

As later described, the fixtures are preferably designed to contact the manufactured part with a two point contact substantially perpendicular through the center of the manufactured part and parallel to the line of clamp separation (see FIGS. 2 and 4). With this design, the simple direction contact movement is designed to be substantially perpendicular to a line through the two point contacts, and even more preferably the center of such line. This movement provides for a solid four point contact for each rotor being manufactured (two on each side), thus solidly retaining same. In the embodiment of FIG. 2, the separation/declamping line would be at 95, thus providing for two symmetrical clamps retaining the rotor in a balanced fashion (i.e., four parallel lines). Note that it is the relative stability of contact between the positioning rolls and the rotors that is preferred and not necessarily the specific movements that provide for such stable contact. For example, movement of both rolls 84, 85 perpendicular to each other's lines of contact would solidly lock the rotor in position. Therefore other clamps, separation movement, etc. could be utilized if desired and/or appropriate.

Note that solid contact is particularly important during the reference grinding operation. In the initial reference grind by solidly holding the rotors, and in the finish production grind by reducing the possibility of minor clockwise rotation of the rotors (otherwise possible due to a slight shifting to single point contact with the rolls 84, 85 due to the lateral location thereof in combination with the slightly larger reference valleys and the grinding wheel's action thereon).

In the preferred embodiment, the part contact is also substantially lateral of the main forces developed during the manufacturing operation. This causes such main forces to be transferred efficiently through the fixture 80 to a solid support member. In the preferred embodiment, these forces are on an engagement angle substantially perpendicular to the base 87 upon which the fixture 80 resides (i.e., in line with the rotational axis of the grinding wheel 40). This efficient transfer is facilitated by the location of the actual support (the later described positioning rolls) substantially in line with the manufacturing forces. Both add to the repeatability and longevity of maintaining the desired tolerances in the device. Further, the fixture 80 extends in contact with each manufactured part, thus individually locating such part along with the other parts.

The actual point(s) of contact between the fixture(s) and part(s) is selected such that the selected point(s) can act as a reference point for future manufacturing operations, preferably in a predictable sequence.

In the embodiment disclosed, the fixture contact is through one positioning roll 84 located near the top of the manufactured part with the other roll 85 being located near the bottom of the manufacturing part. The actual positions of the rolls are preferably selected so as to allow the fixtures to both move in one direction, diagonally as shown, between disengaged and engaged positions without any interference from a rotor lobe while also providing a solid location of the rotor during the grinding operation. Thus a simple, repeatable one direction movement solidly locks the rotors 30 in respect to the grinding wheel.

In the embodiment disclosed, the movable fixtures 81, 82 include two positioning rolls 84, 85 which engage the outer surface of the part in order to retain such part in an operative position as well as providing a reference point for the manufacturing operation. In this example, positioning rolls are preferred for establishing the contact point(s) due to the use of rolls in the finished device (i.e., the roll geometry being understood). The positioning rolls 84, 85 are at least the same size as in the production stator to be utilized with a rotor being ground. It is further preferred that the rolls 84, 85 be slightly larger in diameter than this minimum. This oversizing provides for a solid two point contact between each roll and the adjoining rotor, thus optimizing the retention of such rotor.

In the preferred embodiment, the rolls 84, 85 are directly opposed to each other with one roll 84 being located adjacent to the grinding wheel 40 with the other 85 located near to the valley directly opposite the grinding wheel. The former encourages the use of a previously ground rotor valley as a reference (for example by indexing the rotor one valley counter clockwise or three valleys clockwise in FIG. 2). The latter provides for a support for the rotor during the grinding operation without the complications of a fixture movement into the valley directly opposed to the grinding wheel; a position necessitating a vertical movement of the arbor 20 and/or the fixture 80.

As previously set forth, in the preferred embodiment disclosed, the use of opposed positioning rolls 84, 85 in combination with the geometry of the rotors 30 being ground further allows for two initial reference surfaces to be initially utilized as references with pairs of subsequently ground production surfaces utilized as such for future pairs of production grinds (as later described). This both tightens down the part tolerances and facilitates the manufacturing operation.

It is preferred that the positioning rolls 84, 85 be slightly oversized in respect to the rotor valleys 32 they cooperate with to position the rotor 30 for grinding. The reason for this can be understood in reference to the conceptual FIG. 4. In this figure, it can be seen that a positioning roll matching the production stator roll 35 would have a profile substantially matching the valley 32 of the rotor (for a more complete discussion of the particular preferred cutaway gerotor set geometry and lines of action see U.S. Pat. No. 4,859,160, the contents of which are incorporated by reference). Although this would utilize the outside surface of the rotor 30 as a reference, the relatively long contact surface between the roll and rotor is not conducive to manufacturing ease. Further, some shifting is possible. However, as soon as the positioning roll is made oversized, contact at the root 36 of the valley is eliminated and a two point contact 37, 38 is substituted. This contact is inherently stable. The spacing between the two points 37, 38 will increase as the size of the positioning roll is increased (contrast 37A–38A re roll 85A with 37A–38 re roll 85).

As previously set forth, the two point contact provides a very stable retention for the rotor, especially during the initial reference grind and end production grind. The fact that the preferred clamp is located substantially parallel to the lines between these points of contact respectively further facilitates the precision of the grinding operation by encouraging this two point contact.

Note that in the preferred embodiment, the rotors have cutaway external surfaces. With this type of surface, the outer surface of the rotor 30 deviates from an exact developed surface by eliminating non-essential areas called cutaways in order to increase the overall efficiency of the resultant gerotor structure and its valving (see U.S. Pat. No. 4,859,160 previously set forth). For this type of structure, it is preferred that the contact points 37, 38 be spaced from the rotor valley 36 while remaining within the main lines of action 39 for the stator roll neighboring the top dead center roll of a gerotor set. The former provides for a two point contact while the latter insures that the points of contact will be useful in the operation of the subsequently assembled gerotor set. The oversized positioning roll also shifts at least one point of contact (37 in FIG. 4) more towards the centerline plane of the grinding wheel 40, thus allowing for a more efficient transfer of force to the fixture 80. A location within the cutaways of the rotor is not preferred due to the higher and varying tolerances thereat. Note that a particular rotor's continuation of developed shape beyond a main line of action would provide additional room for positioning roll contact thereat.

It is further preferred that the angle between 1) a line 34 through the center of at least one positioning roll to the center of the rotor 30; and, 2) a line through the center of the same positioning roll to a point of contact (for example 37 or 38) respectively be larger than 15° or even 25° and more preferably 30°–40°. This provides for a solid contact between the positioning roll and rotor.

In the preferred embodiment disclosed the production roll 35 has a radius of substantially 0.25". An increase of radius of 0.327 as 85A provides for a contact angle 42 of some 40°, well within the main lines of action. By increasing the radius of a positioning roll to 40 (as in 85) a contact angle 44 of some 36.5° is produced. At the sizing in the example shown, this point of contact is close to the root of the first cutaway. A nominal increase in radius would find the point of contact within the confines of a cutaway from the developed rotor surface. Although possible, it would therefore necessitate a substantial increase in positioning roll radius to cause the point of contact to be past the cutaway at a non-cutaway location on the rotors. This would enlarge the fixture considerably.

Figure 7:
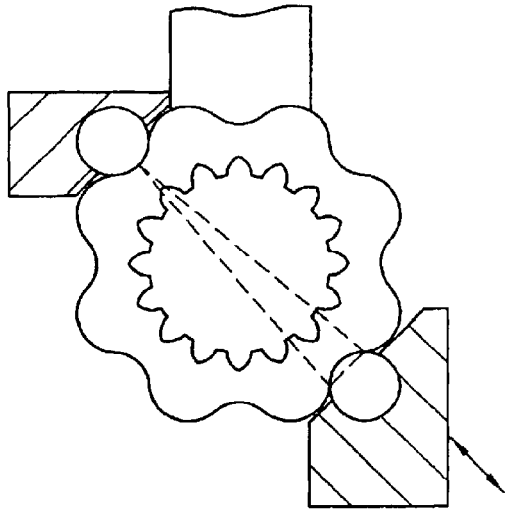

It is preferred that both positioning rolls 84, 85 have substantially the same nature of contacts to the rotor 30. The reason for this is the replication of similar surface contacts during the production clamping by the fixture 80. However, one could produce differential contact by utilizing differing sized positioning rolls 84, 85. This would result from the different spacing between the points of contact 37, 38 for each roll. Under some circumstances one roll could be undersized, thus to provide for an inherently dimension uncritical three point contact (example FIG. 7) especially useful if the points of contact of the other positioning roll were widely spaced).

The points of contact in the preferred embodiment disclosed are provided by two oversized positioning rolls 84, 85 selectively engaged with the rotors 30. As previously set forth, it is preferred that this engagement be provided by a single direction movement of fixtures 81, 82 respectively.

In the embodiment disclosed, the movement of these movable fixtures 81, 82 is provided by a single clamp 90. The clamp 90 shown is a two jaw 91 stationary air chuck manufactured by MicroCentric, Model 4-360NR-3. This unit provides a maximum jaw force of some 540 lbs. at 70 PSI input with the total jaw stroke of approximately 0.36". Accuracy is 0.00001" (jaws 91 shown in representational form in FIG. 2).

The grinding apparatus 10 is utilized to finish grinding the outside surface of the rotors 30 located in sets on the arbor 20. This grinding occurs through a Cubic-Boron-Nitride (CBN) grinding wheel 40 shaped into the final shape of the rotors 30. In the particular embodiment disclosed, this shape extends from at least the centerline of adjoining rotor lobes 31 across one included rotor valley 32. This ensures the grinding of the entire surface of the rotors 30. In the preferred embodiment shown, the grinding wheel shape extends slightly beyond the centerline so as to facilitate merging adjoining grinds. This also allows for some minor finished size adjustment by moving the axis of the grinding wheel 40 differentially in or out in respect to the axis of the rotors. This adjustment can be used to compensate for wear on the grinding wheel 40 as well as allowing for the manufacture of oversized and/or undersized rotors in a single machine.

To accomplish the grinding operation, the CBN grinding wheel 40 is positioned in contact with the stack of rotors 30 and moved longitudinally of the stack while the CBN grinding wheel is in contact with the rotor. This finish grinds the surface of the rotor.

Figure 5:
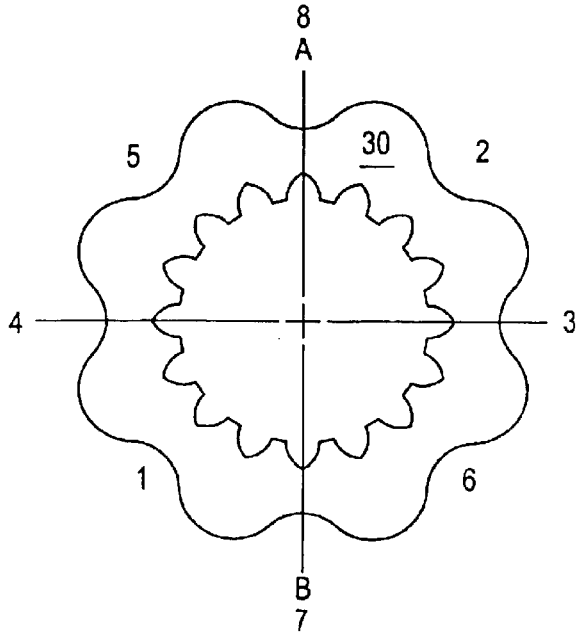
FIG. 5 is a drawing of a rotor of FIG. 1 detailing the preferred grinding order of FIG. 6.
Figure 6:
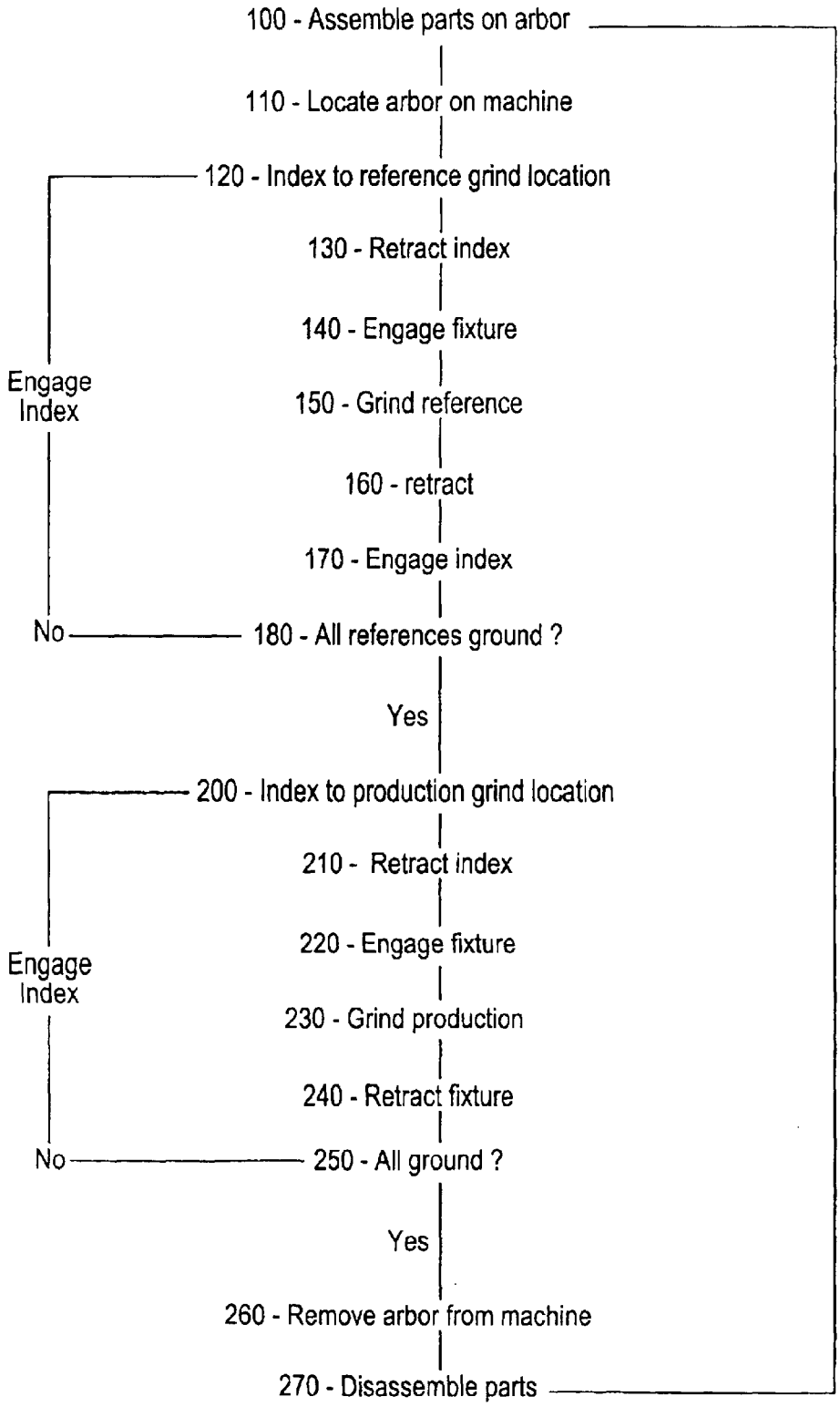
FIG. 6 is a flow chart of the method of grinding developed parts in the order of FIG. 5; and, FIGS. 7, 8, 9, 10, and 11 are cross sectional views like FIG. 2 of the development of alternate clamp fixtures.

The grinding apparatus 10 is utilized with a particular manufacturing technique in order to finish grind the rotors 30 on the arbor of such apparatus (FIGS. 5, 6). In this technique, except for the initial reference rotor valley(s) in the embodiment shown, the part is ground utilizing at least one previously ground surface in contact with the positioning rolls 84, 85 of the fixture 80. This coordinates the grinding operation, thus to reduce tolerances for the resultant manufactured part.

The preferred method begins by assembling the parts to be ground onto the manufacturing machines fixture. In this case, this means locating a series of rotors 30 on the arbor 20 (step 100 in FIG. 6).

After the parts are assembled on the arbor 20, the arbor is located onto the grinding machine (step 110). If not already located in a grinding position with one reference surface to be ground facing the CBN grinding wheel, the indexer 50 locates and retains the arbor in the appropriate position (step 120). At this time the indexer key drive 55 is retracted (step 130) and the fixture 80 engaged (step 140). A reference surface (A) of the rotor is then ground (step 150). The two point contact facilitates the accuracy of this initial grind. At this time the CBN grinding wheel is moved away from the rotors 30, the fixture retracted (step 160) and the indexer engaged (step 170). (Grinding one reference surface may be suitable for subsequent manufacturing operations in certain applications. If multiple reference surfaces are to be ground, as in the preferred embodiment disclosed herein, the index is reengaged and steps 120–170 are repeated until this is accomplished (repeat step 180).

The actual location of a reference grind depends primarily on the locations of the grinding wheel and positioning members. For example, the preferred example has two reference grinds (A, B). These reference grinds both are located to contact positioning rolls 84, 85 respectively of the fixture during the beginning of the production grinding operation. The reference grinds (A, B) are thus 180° apart. This allows for engagement of both of the positioning rolls 84, 85 with these reference surfaces (and later production surfaces) during production grinding. With differing orientations of surface segments and positioning members, the method of grinding order would have to be adjusted to provide for the desired utilization of a prior grind to clamp the member in manufacturing position.

Upon completion of grinding the reference surfaces (A, B), production grinding occurs (steps 200–250). Note that the reference grinds in this embodiment typically would utilize a less rigorous standard than the production grinds due to their use of unground valleys for clamping by the positioning rolls 84, 85 during their initial grinding. It is therefore preferred that these reference grinds be slightly oversized (on the range of 0.001 to 0.005) with a subsequent touch up to production tolerances at a later time when a production grind(s) can be utilized as a standard.

Production grinding occurs when at least one reference surface is in contact with the fixture. Preferably this reference surface is located adjoining or close to the first production grind surface so as to accurately locate same. In subsequent production grinding, adjoining or close previously ground surfaces can be utilized as location surfaces.

In the preferred embodiment shown, the rotors are indexed one valley counterclockwise such that the second ground reference surface (B) is in position to be engaged by the positioning roll 84 of the fixture 80 and the first reference grind (A) is in position to be engaged by the positioning roll 85.

At this time, the indexer is retracted (step 210) and the fixture 80 is engaged to capture the rotors 30 in operative position (step 220). With the rotors so clamped, the reference for the manufacturing operation is the external reference ground surfaces of the rotors 30 and not the center. At this time the grinding wheel is lowered into contact with the rotor stack and the first production (1) valley 32 ground (step 230).

After the first production (1) valley 32 is ground, the grinding wheel 40 is disengaged from the rotors and the fixture 80 moved out of contact with the rotors 30 (step 240). If less than the entire rotor 30 has been ground, the indexer 50 indexes the rotors and the process repeated (step 250). In the preferred embodiment herein, the second production grind (2) is located such that both reference grinds (A, B) are again in contact with both rolls 84, 85 respectively. The rotors on the mandrel 20 are thus indexed 180° from the first production grind (1), effectively reversing the contact of the positioning rolls in respect to the reference grinds. The third (3) and fourth (4) production grinds use the first two production grinds (2, 3) to clamp the rotors by the rolls, again indexing one valley counterclockwise for the third (3) and 180° additional for the fourth (4) production grind. This process then repeats with each pair of opposing production grind serving to clamp the rotors for the following two production grinds. Note that as previously set forth, it is further preferred to use the last set of production grinds (5, 6) to touch up the reference grinds (A, B) in a final production grinding operation (7, 8), thus to cause a common standard of the production grinds tolerances for the entire rotor. Note that as previously set forth, the two point contacts in combination with the diagonal clamping motion prevent the rotor stack from rotationally slipping during this final grinding operation. This avoids problems that might occur if a smaller grind (a production grind) was to be utilized as a clamping reference for the final touch up of the initial reference grind (i.e., a slight clockwise shifting of the rotor stack is avoided during this final operation).

When all of the external surfaces have been ground, the arbor 20 is removed from the grinding apparatus 10 (step 260) and disassembled (step 270).

At this time, a second set of rotors 30 are assembled onto the arbor and the process repeating itself in a subsequent manufacturing process.

Although the invention has been described in its preferred form with a certain degree of particularity, it is to be understood that numerous changes can be made without deviating from the invention as herein after claimed.

Figure 8:
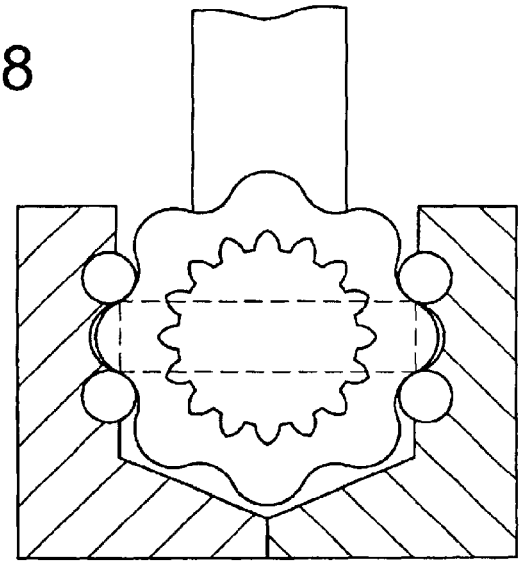
Figure 9:
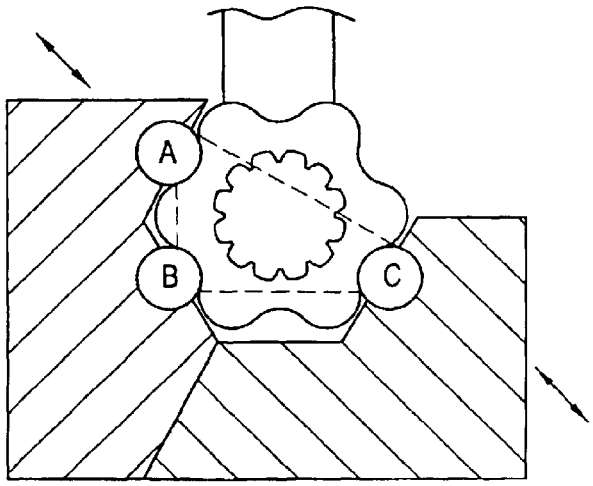
Figure 10:
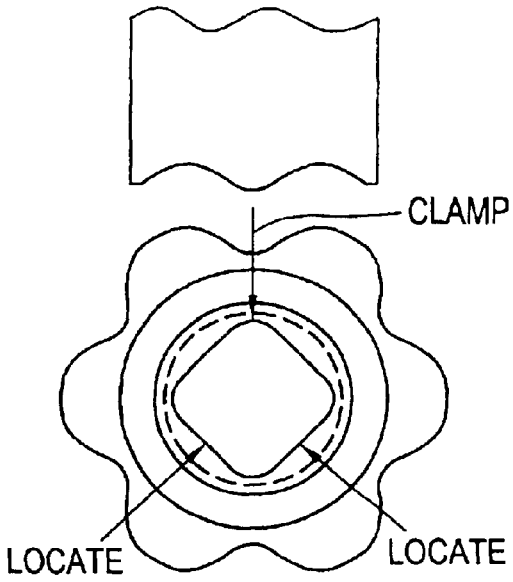
Figure 11:
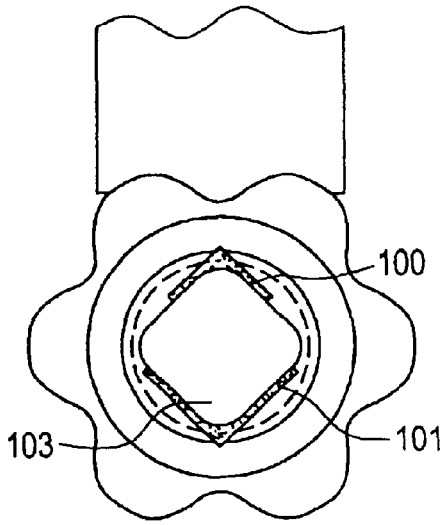

For example, although the invention has been described in its preferred embodiment utilizing an eight lobed rotor with two positioning rolls, it can be utilized with variations. For example, although singular rolls are disclosed having two contact points each, the fixtures could be modified for multiple roll contact, each roll having a single contact point (FIG. 8), this produces a four roll four point fixture in the example shown. Additional example: FIG. 9 is a drawing of a six lobed rotor in a three fixture roll each with two contact points. It can be ascertained that there are four positions where a roll can be located to clamp the rotor substantially perpendicular to the grinding wheel while still maintaining a single direction engagement. Three positions (a, b, c) are utilized for this fixture (for reasons previously explained, note the very wide six point contact of this embodiment). Further, although a single fixture is utilized for both reference and production grinds, two fixtures and/or a combination fixture could be utilized. An example of this is shown in FIGS. 10 and 11 wherein two selectively engaged "V" shaped clamps 100, 101 are utilized with a square 103 on the arbor 20 to retain the rotors 30 in position for relatively uncritical initial reference grinds. This allows these two grinds to be made on a $500. machine instead of a $100,000, machine (subsequent production grinds would preferably be made on the more expensive machine). Similarly, although the positioning rolls are disclosed separate from the rest of the fixture 80, the fixture 80 could have a solid formed shape replicating the shape produced by the positioning roll without deviating from the claimed invention. The word roll thus includes this multiplicity and this formed shape. A further modification would be to index the rotors such that only one positioning roll engages a previously ground segment prior to grinding the next segment. An example of this would be to index the rotor 30 in FIG. 2 one valley counterclockwise for each grind, perhaps even omitting positioning roll 85. This would be suitable for less pressure sensitive gerotor structures. With a similar action, one could also grind reference grinds until at least both rolls are engaged with such, and utilize production grinds. Other modifications are also possible without deviating from the claimed invention.

What is claimed:

1. An improvement for an apparatus using a formed grinding wheel to grind a member having an external developed surface with at least two segments, the improvement comprising means for connecting the formed grinding wheel to the apparatus, a location means to locate and retain one segment of the developed surface with a positioning roll connected to a moveable clamp, and means to operate the formed grinding wheel to grind a different segment of the developed surface.

2. The apparatus of claim 1 wherein the external developed surface has a developed valley and characterized in that a line from the center of the positioning roll to the different segment through the bottom of the developed valley being ground forms an angle less than 60°.

3. The apparatus of claim 1 using a formed grinding wheel to grind a member having an external developed surface with at least three segments, the improvement of locating means for locating and retaining two segments of the developed surface with positioning rolls connected to a moveable clamp and then using a grinding means to grind a different segment of the developed surface.

4. The apparatus of claim 1 using a formed grinding wheel to grind a member having an external developed surface with at least three segments, there are two segments of the developed surface having a valley having a size the improvement of locating means for locating two segments of the developed surface with positioning rolls connected to a moveable clamp, the positioning rolls engaging same respectively have a size greater than the size of the valley with such positioning rolls having a two point contact with such valley, and then using a grinding means to grind a different segment of the developed surface.

5. An improvement for an apparatus using a formed grinding wheel to grind a member having an external developed surface with at least two segments, one segment of the developed surface has a valley having a size, the improvement comprising means for connecting the formed grinding wheel to the apparatus, a location means to locate one segment of the developed surface with a positioning roll connected to a moveable clamp, said location means utilizes a positioning roll a size greater than the size of the valley with the positioning roll having a two point contact with such valley, and means to operate the formed grinding wheel to grind a different segment of the developed surface.

6. The apparatus of claim 5 characterized in that a line between said two points of contact with the valley is between 0° and 60° in respect to a segment perpendicular through the center of said positioning roll and the center of said line.

7. The apparatus of claim 5 wherein the formed grinding wheel has an axis of rotation and characterized in a line extending through said two points of contact of the positioning roll with the valley intersects the axis of rotation of the formed grinding wheel at an angle of between 30° and 60°.

8. The apparatus of claim 5 characterized in that said locating means utilizes two points of contact established by two different positioning rolls.

9. The apparatus of claim 5 wherein the member is a rotor and characterized in that said locating means utilizes a segment line running through the two points of contact substantially perpendicular to a line running from the center of the rotor through said segment line.

10. The apparatus of claim 9 characterized in that said locating means utilizes multiple positioning rolls, multiple segments, and multiple perpendiculars.

11. The apparatus of claim 5 wherein the member is a rotor with main lines of action in respect to a certain valley and characterized in that said locating means utilizes points of contact within said main lines of action.

12. The apparatus of claim 5 wherein the member is a rotor with main lines of action in respect to a certain valley and characterized in that said locating means utilizes points of contact at said main lines of action.

13. The apparatus of claim 5 wherein the member is a rotor with main lines of action in respect to a certain valley and characterized in that said locating means utilizes points of contact are outside of said main lines of action.

14. The apparatus of claim 5 characterized by an additional developed surface and an additional positioning roll and said locating means utilizes said additional positioning roll having a one point contact with said additional developed surface.

15. An improvement for an apparatus using a formed grinding wheel to grind a member having an external developed surface with at least two segments, the improvement comprising means for connecting the formed grinding wheel to the apparatus, a location means to locate one segment of the developed surface with a positioning roll connected to a moveable clamp, said locating means utilizes two or more positioning rolls, and means to operate the formed grinding wheel to grind a different segment of the developed surface.

16. An improvement for an apparatus using a formed grinding wheel to grind a member having an external developed surface with at least two segments, the improvement comprising means for connecting the formed grinding wheel to the apparatus, a location means to locate one segment of the developed surface with a positioning roll connected to a moveable clamp, said locating means utilizes three or more positioning rolls, and means to operate the formed grinding wheel to grind a different segment of the developed surface.

17. An improvement for an apparatus using a formed grinding wheel to grind a member having an external developed surface with at least two segments, the improvement comprising means for connecting the formed grinding wheel to the apparatus, a location means to locate one segment of the developed surface with a positioning roll connected to a moveable clamp, grinding means to rough ground one segment of said developed surface as a reference surface prior to production grinding the different segment of the developed surface, and means to operate the formed grinding wheel to grind a different segment of the developed surface.

18. An improvement for an apparatus using a formed grinding wheel to grind a member having an external developed surface with at least two segments, there are two positioning rolls, the member has first and second segments of the developed surface and at least a third segment of the developed surface, the improvement comprising means for connecting the formed grinding wheel to the apparatus, a location means to locate one segment of the developed surface with a positioning roll connected to a moveable clamp, means for locating the first and second segments in succession for grinding, means for engaging the first and second segments with the positioning rolls respectively before grinding the third segment, and means to operate the formed grinding wheel to grind a different segment of the developed surface.

19. The apparatus of claim 18 wherein a finished segment has a certain size and characterized in that the first and second segments are ground oversized as reference grinds while the third segment is ground as a finished segment of its certain size.

20. The apparatus of claim 19 characterized by the addition of an index means and wherein the member has a fourth segment and after the third segment is ground the index means are utilized such that the two positioning rolls are engaged with differing surfaces of the first and second segments respectively prior to grinding the fourth segment.

21. The apparatus of claim 20 wherein the member has a fifth segment and after the fourth segment is ground, the index means indexes the member such that the two positioning rolls are engaged with the third and fourth segments prior to grinding the fifth segment.

22. The apparatus of claim 21 characterized in that the index means has two positioning pieces and wherein the member has a sixth segment and after the fifth segment is ground, the index means indexes the member such that the two positioning pieces are engaged with differing surfaces of the fourth and fifth segments respectively prior to grinding the sixth segment.

23. The apparatus of claim 21 characterized in that the first and second segments are coextensive with the fifth and sixth segments.

24. The apparatus of claim 21 wherein the index means has two positioning pieces and characterized by engagement means for engaging the fifth and sixth segments with the two positioning pieces prior to regrinding one of the first or second segments.

25. The apparatus of claim 18 characterized in that the two positioning rolls are angularly spaced by a certain number of degrees and the first and second segments are angularly spaced by the same number of degrees for engagement therewith prior to grinding the third segment.

26. The apparatus of claim 25 characterized in that the third segment is adjacent to one of the first or second segment.

27. The apparatus of claim 18 characterized means to angularly space the first and second segments by substantially 180°.

28. An improvement for an apparatus using a formed grinding wheel to grind a member having an external developed surface with at least four segments, the improvement comprising means for connecting the formed grinding wheel to the apparatus, a location means to locate one segment of the developed surface with a positioning roll connected to a moveable clamp, means for locating and retaining three segments of the developed surface with positioning rolls connected to a moveable clamp means to operate the formed grinding wheel to grind a different segment of the developed surface, and using a grinding means to grind a different segment of the developed surface.

29. The apparatus of claim 28 wherein there are three segments of the developed surface having a valley having a size and characterized in that the positioning rolls engaging same respectively have a size greater than the size of the valley with such positioning rolls having a two point contact with such valley.

30. The apparatus of claim 29 wherein the member has a seventh segment and indexing means to index the member after the sixth segment is ground, such that the two positioning rolls are engaged with the fifth and sixth segments prior to grinding the seventh segment.

31. The apparatus of claim 30 wherein the member has a eighth segment and indexing means to index the member after the seventh segment is ground, to index the member such that the positioning pieces are engaged with differing surfaces of the fifth and sixth segments respectively prior to grinding the eighth segment.

32. The apparatus of claim 31 characterized in that the first and second segments are coextensive with the seventh and eighth segments.

33. An apparatus for positioning a member having a developed surface in respect to a grinding wheel, the developed surface including a segment, the apparatus including a fixture, said fixture being larger than the segment, and engagement means to engage said fixture with the segment at only two points in a direction substantially perpendicular to a line through said two points to retain the member in respect to the grinding wheel.

34. The apparatus of claim 33 characterized in that said engagement means includes movement of said fixture.

35. An apparatus for positioning a member having a developed surface in respect to a grinding wheel having an engagement angle, the developed surface including a segment, the apparatus including a fixture and engagement means to engage said fixture with the segment in a direction substantially perpendicular to the engagement angle of the grinding wheel to retain the member in respect to the grinding wheel, and means to move the grinding wheel to grind oversized reference grinds until one such reference grind is in engagement with said fixture.

36. An apparatus for positioning a member having a segment of a developed surface, the apparatus including a positioning fixture and said positioning fixture contacting the segment at only two points to position and retain the member in the apparatus, said positioning fixture including a roll in contact with the segment at said only two points.

37. An apparatus for positioning a member having a segment of a developed surface, the apparatus including a positioning fixture, said positioning fixture including a roll contacting the segment at only two points, the segment has a size and said roll having a size greater than the size of the segment.

38. The apparatus of claim 37 characterized in that said positioning fixture is external to the segment.

39. An apparatus of claim 37 wherein the member is a rotor having main lines of action and characterized in that said two points of contact are located within said main lines of action.

40. An improvement for an apparatus for positioning a rotor having a valley inclusive segment, the valley having a size, the improvement of a positioning roll, said positioning roll having a size, said size of said positioning roll being greater than the size of the valley and said positioning roll being in contact with the valley to position the rotor to position and retain the rotor in the apparatus.

* * * * *